United States Patent [19]

Chien

[11] Patent Number: 4,885,570

[45] Date of Patent: Dec. 5, 1989

[54] STEAL AND BURGLAR PREVENTIVE PURSE

[76] Inventor: Darin Chien, 4F, No. 276, Pa-Teh Rd., Sec. 4, Taipei, Taiwan

[21] Appl. No.: 277,693

[22] Filed: Nov. 30, 1988

[51] Int. Cl.[4] ..... G08B 13/14; A45C 13/24

[52] U.S. Cl. ..... 340/571; 340/574; 340/652; 340/540; 150/101; 150/102

[58] Field of Search ..... 150/101, 102; 340/540, 340/550, 571, 573, 574, 652

[56] References Cited

U.S. PATENT DOCUMENTS

| | | | |
|---|---|---|---|
| 3,701,140 | 10/1972 | Dixon | 340/571 |
| 3,851,326 | 11/1974 | Costa | 340/571 |
| 3,938,126 | 2/1976 | Ransom | 340/571 |

FOREIGN PATENT DOCUMENTS

| | | | |
|---|---|---|---|
| 8403208 | 8/1984 | Fed. Rep. of Germany | 150/102 |
| 2519787 | 7/1983 | France | 340/571 |

*Primary Examiner*—Joseph A. Orsino
*Assistant Examiner*—Kinfe-Michael Negash

[57] ABSTRACT

A purse includes a wavy wire fully distributed on a purse casing and an alarm formed in the casing whereby upon a cutting or breaking of the wire by a thief or pickpocket, the disconnection of wire will actuate the alarm sounding for preventing its robbing, and also includes an emergency switch which is operated by pulling a handle or belt of the purse to disconnect the wire for sounding the alarm.

9 Claims, 4 Drawing Sheets

STEAL AND BURGLAR PREVENTIVE PURSE

BACKGROUND OF THE INVENTION

Steck et al. disclosed a self actuating wallet alarm in their U.S. Pat. No. 3,930,249 by incorporating therewith an electronic circuit capable of emitting an audible alarm when a wallet or the like is removed from an owner's pocket as subjected to a light variation or a temperature difference between an owner's body and an environment.

However, if the wallet or purse is stolen or picked in a dark surrounding the alarm will not be actuated, due to no variation of light intensity, thereby losing its alarming effect. Or, if the wallet is subjected to a very strong sunlight, the alarm will be falsely actuated even kept in an owner's pocket.

The present inventor has found the aforementioned drawback of a conventional wallet or purse, and invented the present steal and burglar preventive purse.

SUMMARY OF THE INVENTION

The object of the present invention is to provide a purse having a continuous wavy wire thoroughly distributed on the purse casing and electrically connected with an alarm circuit provided in the purse so that once the purse is cut by a pickpocket the wavy wire will be broken to actuate an alarm sounding, thereby preventing the loss of such a purse.

Another object of the present invention is to provide a purse having an emergency switch provided on a purse handle or belt so that once the purse is robbed and pulled by a robber, the emergency switch will be actuated to sound an alarm to prevent a robbing of the purse.

Further objects and details of the present invention will be described hereinafter with reference to the accompanying drawings.

DETAILED DESCRIPTION

Figure 1:
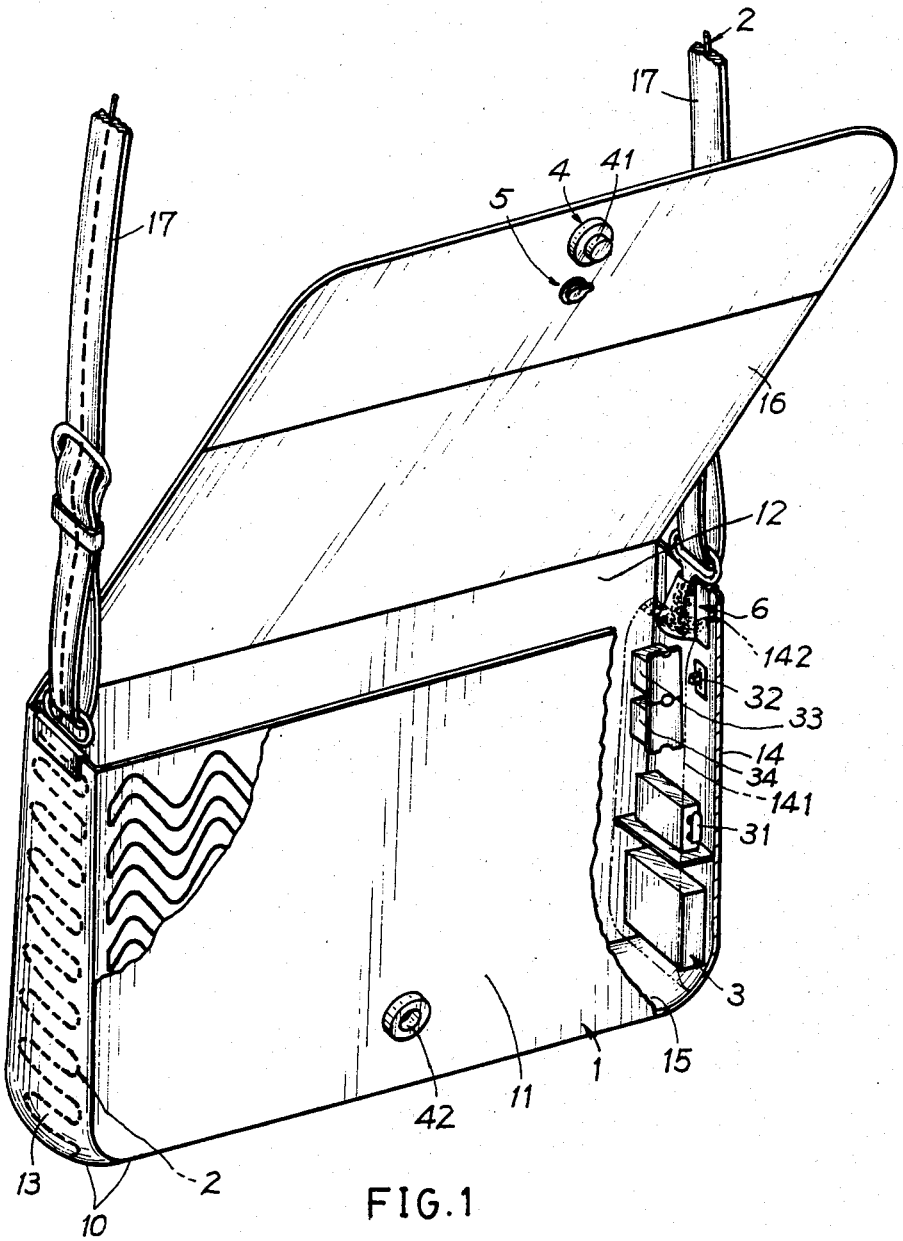
FIG. 1 is a perspective view of the present invention.

As shown in FIGS. 1–6, the present invention comprises: a purse means 1, a built-in sensing network 2, an alarm circuit means 3, an inner magnetic switch 4, an externally-operating camouflage switch 5, and a pulling-actuated emergency switch 6.

The purse means 1 include: a casing 10 composed of a front sheet member 11, a rear sheet member 12, a left sheet member 13, a right sheet member 14, and a bottom sheet member 15, a cover 16 pivotally closing the casing 10, and a handle or belt 17 holding the two side members 13, 14. The cover 16 is closing on the front member

11 by magnetically attracting an upper contactor 41 formed on an inside surface of the cover 16 to a lower contactor 42 formed on an outer surface of the front member 11. In the right sheet member 14, a liner bag 141 is formed therein to incorporate the electric circuit means 3 in the bag 141. The camouflage switch 5 protrudes outwardly from the cover 16 to form a button rotatable or depressible by any one. On the rear member 12, two openings 121 are provided for mounting two buzzers 33, 34 of the alarm circuit 3. The bag 141 is formed with a top opening having a fastener 142 secured thereon.

Figure 2:
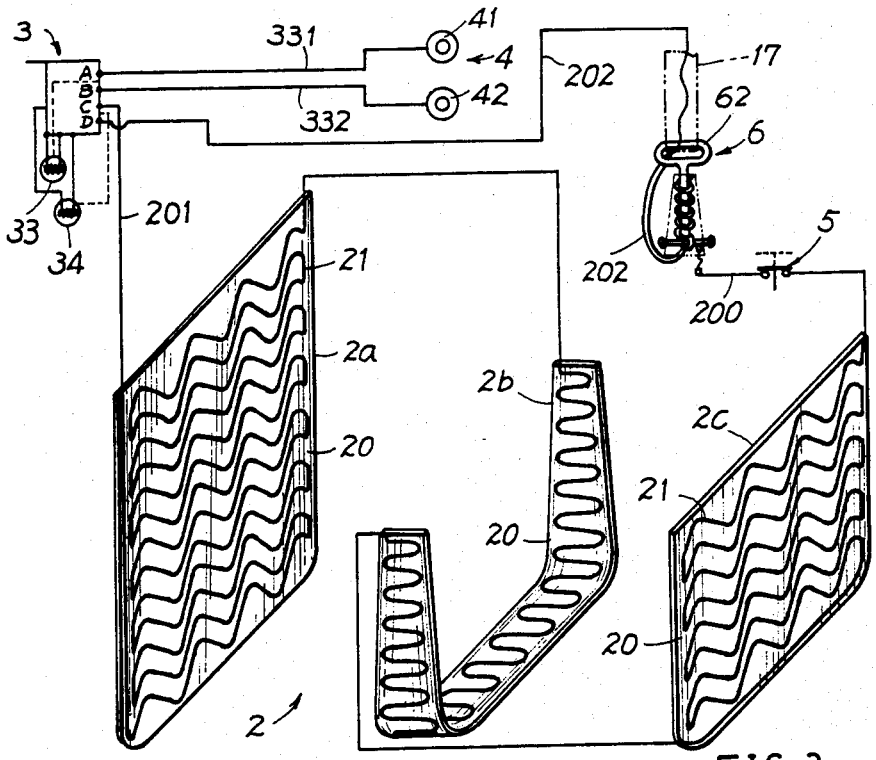
FIG. 2 is an illustration showing a built-in sensing network of the present invention.

The built-in sensing network 2 as shown in FIG. 2 includes a continuous wire having an inlet lead wire 201 connected to a terminal C of the alarm circuit means 3, a rear wavy wire portion **2*a* disposed on a generally full area of the cover 16 and rear sheet member 12 connected to the lead wire 201, a side wavy wire portion 2*b* disposed on the side sheet members 13, 14 and bottom member 15 and connected to the rear wire 2*a*, a front wavy wire portion 2*c* connected to wire 2*b* disposed on a generally full area of the front member 11, an intermediate lead wire 200 connected between the emergency switch 6 and the front wire portion 2*c*, disposed on belt 17, and an outlet lead wire 202 connected between the switch 6 and a terminal D of the circuit means 3**.

The wavy wires **2*a*, 2*b*, 2*c* may be formed as a plurality of rows of corrugate waves 21 consecutively respectively arranged on either sheet member 11 or 12**, all rows of waves being projectively superimposed with one another and forming a continuous wire.

The wavy line may also be formed as zig-zag densely distributed on the sheet members. The wavy wire 2 may be fixed, adhered, bound, sewn or embedded on each sheet member and further covered or lined with an insulator cloth or paper 20.

Figure 5:
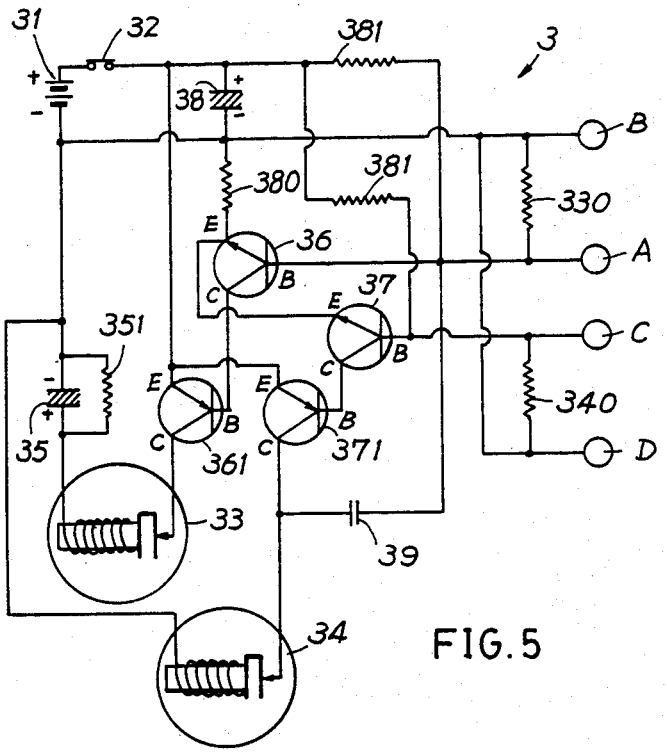
FIG. 5 shows an electric circuit diagram of an alarm circuit means of the present invention.

The alarm circuit means 3 as shown in FIG. 5 includes: a power source 31 of 9 volts dry cells, a main switch 32 formed in bag 141 for manually switching off an alarm sounding of the circuit 3, a short-alarming buzzer 33 of 3 volts, a long-alarming buzzer 34 of 6 volts, a first capacitor 35 or 200 μF connected in parallel with a resistor 351 of 5.1 Kilo-ohms connected between the power source 31 and the buzzer 33, a first transistor 36, a second transistor 361, a third transistor 37, a fourth transistor 371, a second capacitor 38 of 100 μF connected between a positive pole of power source 31 and the first transistor 36 through a resistor 380, and a third capacitor 39 connected between the positive pole and the buzzer 34 through a resistor 381. A resistor 330 of 10 Kilo-ohms is connected between the terminals A, B, whereas a resistor 340 of 10 Kilo-ohms is connected between two terminals C, D.

The first transistor 36 has its base B connected to terminal A, its emitter E connected to the positive pole through the second capacitor 38, and its collector C connector to a base B of the second transistor 361. The second transistor 361 has its emitter E connected to the positive pole and its collector C connected to the short-alarming buzzer 33.

The third transistor 37 has its base B connected to terminal C, its emitter E connected to positive pole through second capacitor 38, and its collector C connected to a base B of the fourth transistor 371. The fourth transistor 371 has its emitter E connected to the positive pole and its collector C connected to the buzzer 34.

Terminals D and B are respectively connected to negative pole of the power source. The long-alarming buzzer 34 is connected between the negative pole of power source and the fourth transistor 371. Terminals A, B are respectively connected to an upper contactor 41 and a lower contactor 42 of the magnetic switch 4.

Figure 3:
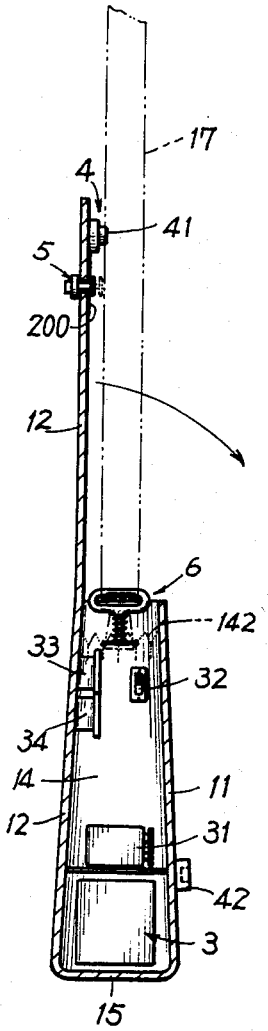
FIG. 3 is a side-view illustration of the present invention.

The camouflage switch 5 may be formed as a depressible or a rotatable button operatively cutting off a wavy wire 200 as shown in FIGS. 2 and 3 connected across the two terminals C, D.

Figure 4:
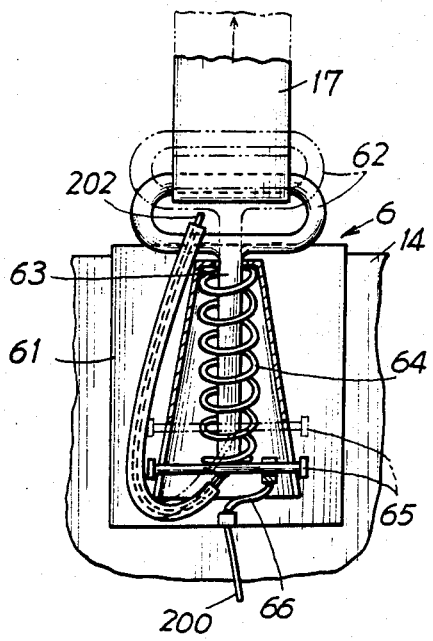
FIG. 4 shows an emergency switch of the present invention.
Figure 6:
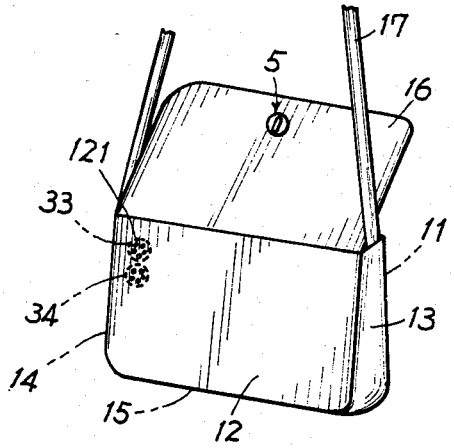
FIG. 6 is a back-view illustration of the present invention.

The emergency switch 6 as shown in FIGS. 2, 4 includes: a fixing plate 61 fixed inside the right member 14 of casing 10 for mounting the switch 6, a loop 62 for connecting a lower end portion of the handle or belt 17, a central rod 63 slidingly formed in the plate 61 protruding downwardly from the loop 62, a restoring spring 64 normally tensioning the rod 63 downwardly against the plate 61 to resiliently force a horizontal upper wire 65, secured to the rod 63 and connected to an outlet lead wire 202 of the sensing network 2, to contact an arcuate lower wire 66 connected to the intermediate wire 200 of the sensing network 2. The resilience of the spring 64 should resist a gravity of the purse under normal load to prevent unexpected separation of the wire 66 from wire 65 and prevent any false alarm of the present invention.

When using the present invention, if any thief or pickpocket uses a knife or scissor to cut the purse trying to take somethings in the purse, the wavy line 2 fully distributed on the casing sheet members 11, 12, 13, 14, 15, 16 will also be cut to disconnect terminals C, D, the potential at base B of third transistor 37 will become low and the second capacitor 38 will discharge to conduct a biasing current through the emitter E and base B of transistor 37 to thereby conduct the transistor 37, and to subsequently conduct the fourth transistor 371 to cause a continuous alarm sounding of the long-alarming buzzer 34, to scare the thief, until switching off the main switch 32.

If a burglar tries to rob a purse of the present invention, his powerful pulling of belt 17 or purse 1 may pull the loop 62, rod 63 and the wire 65 to separate the wire 66 to disconnect the terminals C, D to sound an alarm as aforesaid.

If a thief operates the button of the camouflage switch 5, his depression of the button may also disconnect the terminals C, D to actuate the alram. All the alarms actuated by the stealing or robbing actions may actuate the long-alarming buzzer 34.

If the purse owner opens her purse cover 16, the terminals A, B will be disconnected to saturate the first and second transistors 36, 361 to actuate the short-alarming buzzer 33 which may be prolonged for a very short period such as a short sound of "Bi", as effected by the first capacitor 35 and resistor 351 parallelly connected between the power source 31 and the buzzer 33. Such a short alarm may not disturb the purse owner or her surroundings.

Figure 7:
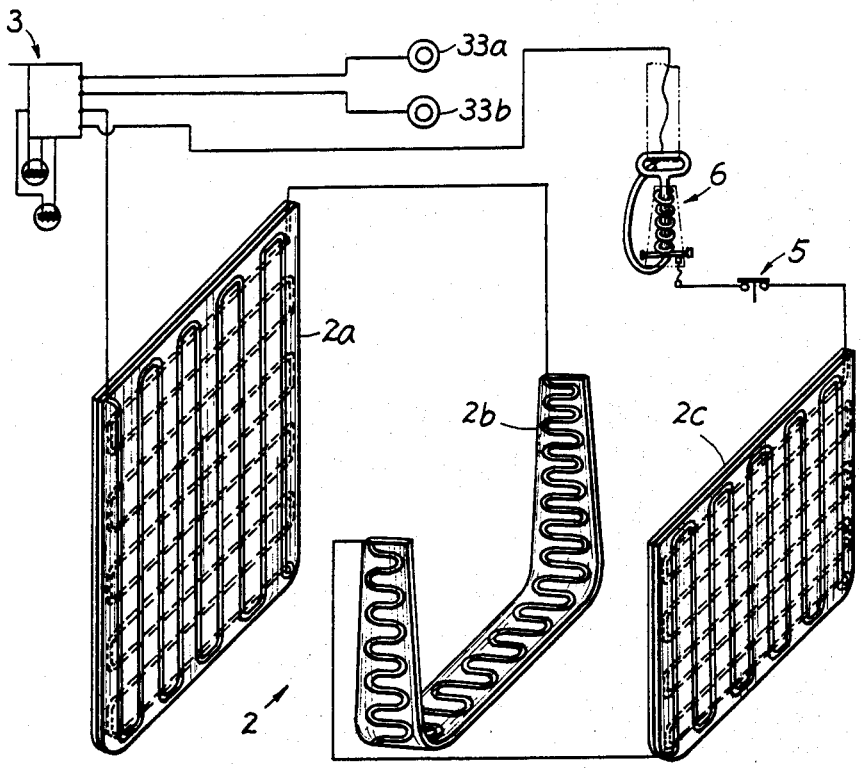
FIG. 7 shows another preferred embodiment of the sensing network of the present invention.
Figure 8:
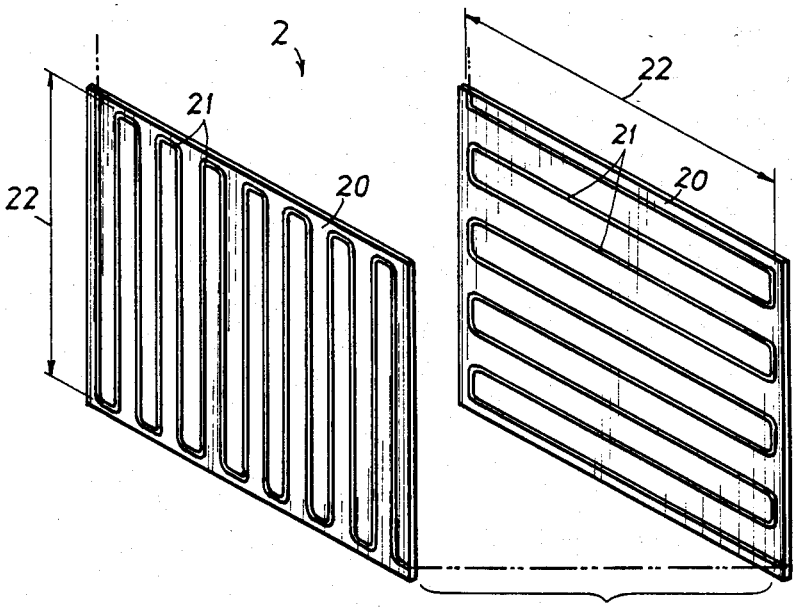
FIG. 8 is an illustration showing the formation of the sensing network as shown in FIG. 7.

The sensing network 2 may also be formed as shown in FIGS. 7, 8 as a wavy wire having a plurality of rectangular waves 21 continuously connected with one another to form a first set of rectangular waves 21 having amplitudes 22 vertically disposed across a height of the sheet member 11 or 12 and fixed on an inner insulator paper or cloth 20, and to continuously form a second set of rectangular waves 21 having amplitudes 22 horizontally disposed across a width of the sheet member fixed on an outer insulator 20. The inner and outer insulators are superimposingly secured to the sheet member.

The present invention has the following advantages superior to a conventional alarming purse or wallet:

1. Regardless of light and temperature variations of the purse storage, the present invention can be effectively actuated either by cutting, pulling of the purse or by depressing a button thereof.

2. Besides an external force applied for actuating the alarm by any intruder, the purse owner may also actuate the emergency switch 6 by herself when she suspects a possible nearby intruder.

3. The sensing network 2 is fully distributed in all areas of the purse to have a perfect protection against any pickpocket's cutting or breaking on the purse from any direction.

What is claimed is:

1. A steal or burglar preventive purse comprising:

a purse means having a casing composed of a plurality of sheet members with a handle or belt holding two side portions of the casing and a cover normally closing said casing;

a built-in sensing network including a continuous wavy wire continuously distributed in a generally full area of the casing; and an alarm circuit means having a main switch of a power source, a short-alarming buzzer electrically connected with a first pair of terminals respectively formed on said cover and a front sheet member of said casing and a long-alarming buzzer electrically connected with a second pair of terminals, across which said continuous wavy wire of said built-in sensing network is connected thereto, each said buzzer having each said pair of terminals nomally closed; whereby upon a cutting or breaking of the wavy wire of said sensing network to disconnect said second pair of terminals of said alarm circuit means bya thief or pickpocket, said long-alarming buzzer is actuated to remind a purse owner to prevent its stealing, until switching off said main switch of the alarm means, and upon an opening of said cover by the purse owner to disconnect said first pair of terminals of said alarm circuit means, said short-alarming buzzer is actuated for its sounding.

2. A purse according to claim 1, wherein said continuous wavy wire of said built-in sensing network is a continuous wire disposed on all sheet members forming the casing, belt or handle, and cover of said purse means; said continuous wavy wire having a plurality of rows of corrugate wves consecutively disposed on each sheet member, all rows of corrugate waves being projectively superimposed with one another.

3. A purse according to claim 1, wherein said continuous wavy wire is formed as a zig-zag shape.

4. A purse according to claim 1, wherein said continuous wavy wire includes a plurality of rectangular waves continuously connected with one another, forming a first set of rectangular waves having amplitudes vertically disposed across a height of a sheet member and fixed on an inner insulating paper or cloth, and continuously forming a second set of rectangular waves having amplitudes horizontally disposed across a width of the sheet member and fixed on an outer insulating paper or cloth, said inner and outer insulating paper or cloth being superimposingly secured to said sheet member of said casing.

5. A purse according to claim 1, wherein a pulling-actuated emergency switch is further incorporated in said sensing network, including a fixing plate secured to a side portion of the casing, a loop secured to a handle or belt of the purse means and having a central rod protruding downwardly from the loop to electrically connect an upper contact of a wire section led to a terminal of said second pair of terminals of the long-alarming buzzer, and a restoring spring normally tensioning the rod downwardly to resiliently contact a lower contact connected to the other wire section led to the other terminal of said second pair of terminals of said long-alarming buzzer, whereby upon a pulling of the belt or the casing to separate the upper contact from the lower contact to disconnect the second pair of terminals of the long-alarming buzzer, a sounding alarm is actuated for burglar prevention.

6. A purse according to claim 1, wherein an externally-operating camouflage switch is formed in said sensing network, having a button protruding outwardly from said cover of said purse, depressible or rotatable to open said sensing network to disconnect the second pair of terminals of said long-alarming buzzer for sounding an alarm.

7. A purse according to claim 1, wherein an inner magnetic switch is provided in said purse means including an upper contactor formed on an inside surface of said cover and a lower contactor formed on an outer surface of a front sheet member of the casing magnetically attracted to said upper contactor, both said contactors being electrically connected to said first pair of terminals connected to the short-alarming buzzer, whereby upon an opening of the cover to separate the upper contactor from the lower contactor, said first pair of terminals of the short-alarming buzzer is disconnected to actuate its alarm sounding.

8. A purse according to claim 1, wherein said alarm circuit means includes: the power source having the main switch for switching off a power of said power source, the short-alarming buzzer connected to said power source through a first capacitor parallelly connected with a resistor, the long-alarming buzzer connected to said power source, a first transistor and a second transistor connected in series between said short-alarming buzzer and said power source and controlled by a second capacitor inserted between the first transistor and the power source, the first pair of terminals connected to both said contactors of said inner magnetic switch and connected between said first transistor and said power source, a third transistor and a fourth transistor connected in series between said long-alarming buzzer and said power source and controlled by said second capacitor, and the second pair of terminals connected to said built-in sensing network and connected between said third transistor and said power source; said first capacitor operatively charging and discharging for an on-off control for the alarming sounding of said short-alarming buzzer; said second capacitor operatively discharging to saturate said first transistor upon a disconnection of said first pair of terminals for sounding said short-alarming buzzer, or discharging to saturate said third transistor upon a disconnection of said second pair of terminals for sounding said long-alarming buzzer.

9. A purse according to claim 1, wherein said wavy wire is insulated or insulatingly lined in the purse casing.

* * * * *